US005893620A

United States Patent [19]

Birgelis

[11] Patent Number: 5,893,620

[45] Date of Patent: Apr. 13, 1999

[54] MULTIPLE SHELF SUPPORT SYSTEM IN COMMON REFRIGERATOR LINER

[75] Inventor: Vitas G. Birgelis, Toronto, Canada

[73] Assignee: Whirlpool Corporation, Benton Harbor, Mich.

[21] Appl. No.: 08/096,458

[22] Filed: Jul. 26, 1993

[51] Int. Cl.[6] ..... A47B 96/02

[52] U.S. Cl. ..... 312/408; 312/406; 312/334.44

[58] Field of Search ..... 312/406, 408, 312/350, 334.44; 108/107, 110

[56] References Cited

U.S. PATENT DOCUMENTS

| | | | |
|---|---|---|---|
| 115,542 | 5/1871 | Trevitt | 108/110 |
| 1,970,213 | 8/1934 | Allyne | 312/408 |
| 1,975,327 | 10/1934 | Loney | 312/408 |
| 2,194,177 | 3/1940 | Rundell | 312/350 X |
| 2,625,928 | 1/1953 | Gould | 312/350 X |
| 2,997,356 | 8/1961 | Hilliker et al. . | |
| 3,661,435 | 5/1972 | Miller . | |
| 3,738,728 | 6/1973 | Eckard | 312/350 X |
| 3,857,624 | 12/1974 | Peterson | 312/408 |
| 3,865,448 | 2/1975 | Winterheimer . | |
| 3,984,163 | 10/1976 | Boorman, Jr. et al. . | |
| 4,022,517 | 5/1977 | Eckert . | |
| 4,244,637 | 1/1981 | Boorman, Jr. . | |
| 4,822,116 | 4/1989 | Relyea et al. . | |
| 4,904,032 | 2/1990 | Jenkins | 312/350 |
| 4,936,641 | 6/1990 | Bussan et al. . | |
| 5,004,302 | 4/1991 | Stocking et al. . | |
| 5,004,305 | 4/1991 | Montuoro | 312/350 X |

FOREIGN PATENT DOCUMENTS

| | | | |
|---|---|---|---|
| 365936 | 5/1990 | European Pat. Off. | 312/334.44 |
| 1064083 | 8/1959 | Germany | 312/334.44 |
| 891501 | 3/1962 | United Kingdom | 312/334.44 |

*Primary Examiner*—Peter R. Brown
*Assistant Examiner*—David E. Allred
*Attorney, Agent, or Firm*—Hill & Simpson

[57] ABSTRACT

Shelf supports in the form of slots are integrally molded within each side wall of a refrigerator liner. The slot in one sidewall is in the same horizontal plane as the slot in the other sidewall. The bottom surface of each of the slots supports a shelf. The slots include an upper surface and lower surface having at least one stop located therebetween and integrally molded with the sidewall in the slot for preventing movement in at least one direction. The liner, therefore, supports fixed shelves, pull-out shelves, cantilever half-shelves, as well as being capable for using with shelves which are supported at both sides by cantilevers such that if a different type of shelf replaces the shelf held on both sides by cantilevers, the liner may be used.

12 Claims, 4 Drawing Sheets

FIG. 9
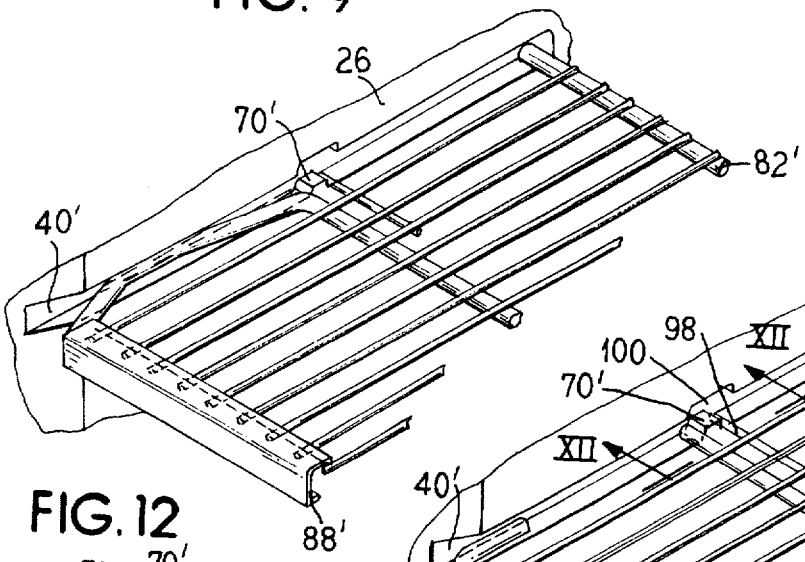
FIG. 10
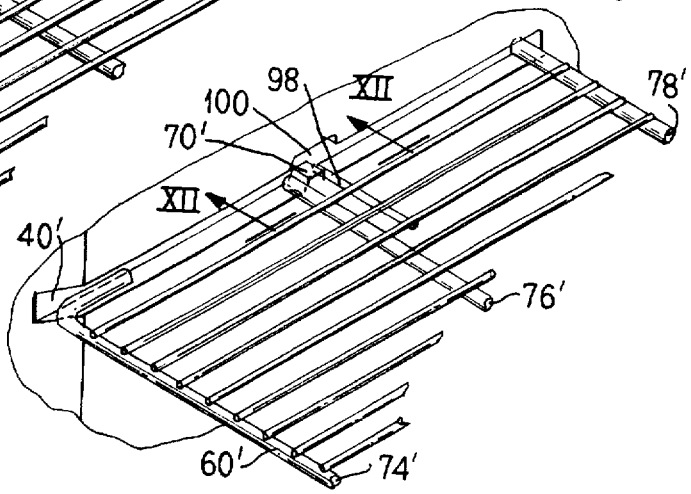
FIG. 12
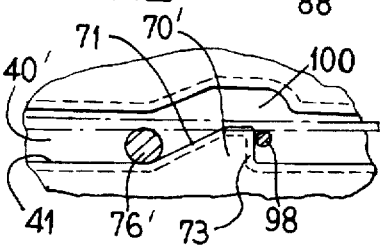
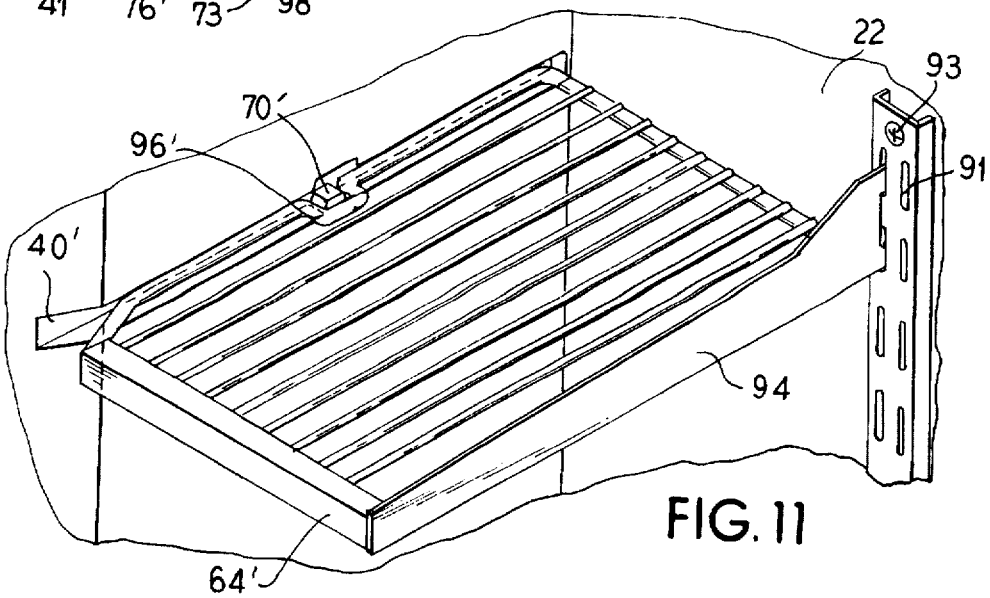
FIG. 11

MULTIPLE SHELF SUPPORT SYSTEM IN COMMON REFRIGERATOR LINER

BACKGROUND OF THE INVENTION

The present invention relates in general to an appliance, such as a refrigerator or freezer, and more particularly to an appliance having one or more shelves supported by an interior liner of the appliance.

A typical refrigerator for refrigerating products, such as food and beverages, has an outer shell with a door which is generally hinged to form at least part of a front wall of the refrigerator. When the door is opened, products may be added to or removed from a refrigerated compartment by an individual.

Generally, refrigerators of this type have one or more shelves horizontally and removably secured within the interior of the refrigerated compartment. Oftentimes, the shelves are placed on brackets which are attached to the liner of the refrigerator wall using a variety of conventional methods, such as ledges attached to the liner wall, ladders attached to the wall on which brackets are secured for holding the shelves, and the like.

Different types of shelving are known including a pull-out shelf, a fixed shelf, a shelf which is half the width of the interior of the refrigerator, a full-width or half-width cantilever shelf, and the like. Traditionally, each of the shelves requires a differently configured liner for the refrigerator so that the particular shelves may be used in the refrigerator. This can be quite costly in terms of inventory since for each type of shelf which is sold in a given refrigerator, a distinct refrigerator liner for holding that particular shelf style is required. In addition, if a shelf needs to be replaced in the refrigerator, only the particular shelf which fits on the liner of the refrigerator may be used.

SUMMARY OF THE INVENTION

The present invention provides a liner for holding shelves within a fresh food compartment or freezer compartment of a refrigerator or freezer. The liner of the refrigerator or freezer has horizontal slots formed integrally within the sidewalls of the liner. Any type of shelf may be used with the liner having the integral shelf supports therein.

In an embodiment, a single stop is formed integrally within each slot for providing the functions of securing a fixed shelf, securing a half-width cantilever shelf, or providing a stop for a pull-out shelf. In another embodiment, two integrally formed stops are included within each slot of the liner. Any type of shelf may be supported, as well, by the two-stop slot of the liner.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures in which like reference numerals identify like elements, and in which:

FIG. 9 is a perspective view of a pull-out shelf in a liner of another embodiment of the present invention.

FIG. 10 is a perspective view of a fixed shelf using the liner of the present invention as illustrated in FIG. 9.

FIG. 11 is a perspective view of a half-width shelf with cantilever support using the liner of the present invention as illustrated in FIG. 9.

FIG. 12 is a fragmentary sectional view taken generally along the line XII—XII as shown in FIG. 10.

DESCRIPTION OF THE PREFERRED EMBODIMENTS

Figure 1:
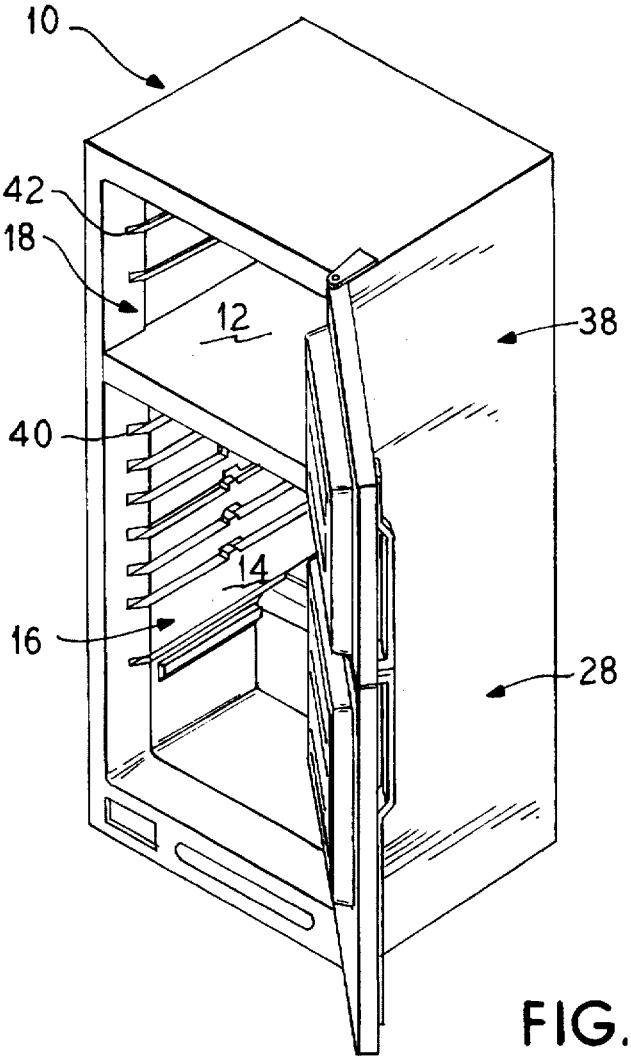
FIG. 1 is a perspective view of a refrigerator cabinet having a shelf support system integrated within a liner embodying the principles of the present invention.
Figure 2:
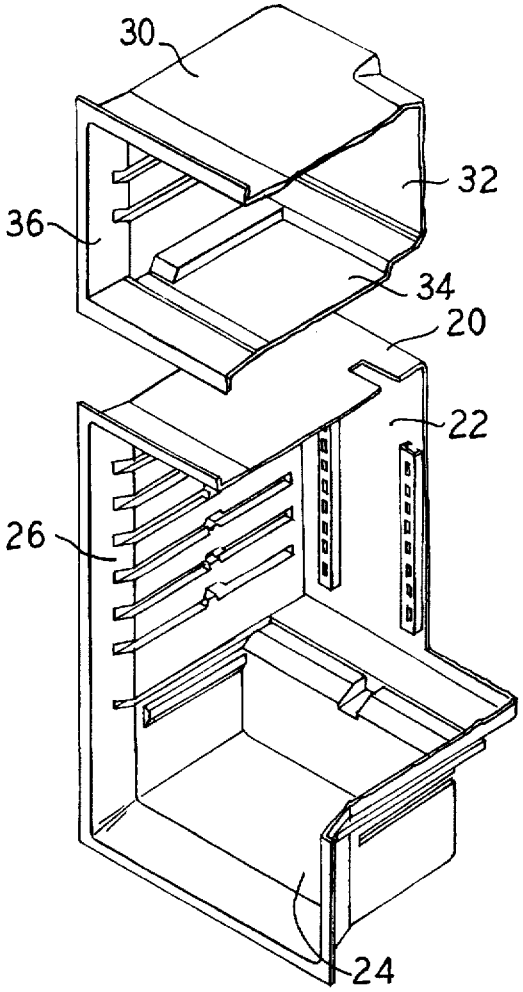
FIG. 2 is a perspective view of the liner of the present invention for a freezer compartment and a fresh food compartment.

The present invention has general applicability to shelving systems encased in a shell, but is most advantageously utilized in an appliance, an example of which is shown in FIG. 1. More particularly, the present invention will be described as used primarily in a refrigerator, freezer or combination refrigerator-freezer.

A refrigerator 10 is generally divided into two sections such as shown in FIG. 1. The top portion is generally a freezer compartment 12 and the bottom portion is generally a fresh food compartment 14. The fresh food compartment 14 is defined by a first liner 16, and the freezer compartment is defined by a second liner 18. The first liner 16 includes a top wall 20, a rear wall 22 substantially perpendicular to a bottom wall 24, and a pair of substantially parallel sidewalls 26 and 28 which are substantially perpendicular to the top wall 20 and the bottom wall 24 and integrally formed therebetween.

The freezer compartment 12 includes a top wall 30, a rear wall 32, a bottom wall 34 and a pair of sidewalls 36 and 38 with the sidewalls 36 and 38 integrally formed with and substantially perpendicular to the top wall 30, the rear wall 32 and the bottom wall 34.

The sidewalls 26, 28, 36 and 38 include a plurality of vertically spaced and generally horizontal shelf slots formed in the walls of the first liner 16 and second liner 18, respectively. The shelf slots 40 formed in the sidewall 26 are in the same horizontal plane as one of the shelf slots 40 in the sidewall 28. That is, the sidewalls 26 and 28 with their respective shelf slots 40 are mirror images of each other.

The freezer compartment 12 further includes shelf slots 42 in each of its sidewalls 36 and 38. The shelf slots 42 in the sidewalls 36 and 38 of the freezer compartment 12, like the fresh food compartment 14, are in the same horizontal plane and are mirror images of each other. As illustrated in FIG. 1, the fresh food compartment 14 includes six shelf slots 40 in each of its sidewalls 26 and 28, and the freezer compartment 12 includes two shelf slots 42 in each of its sidewalls 36 and 38. It should be understood, however, that additional shelf slots or fewer shelf slots may be included in each or both compartments as desired. This is particularly true if different configurations are used for the appliance, such as a side-by-side combination refrigerator/freezer.

Figure 3:
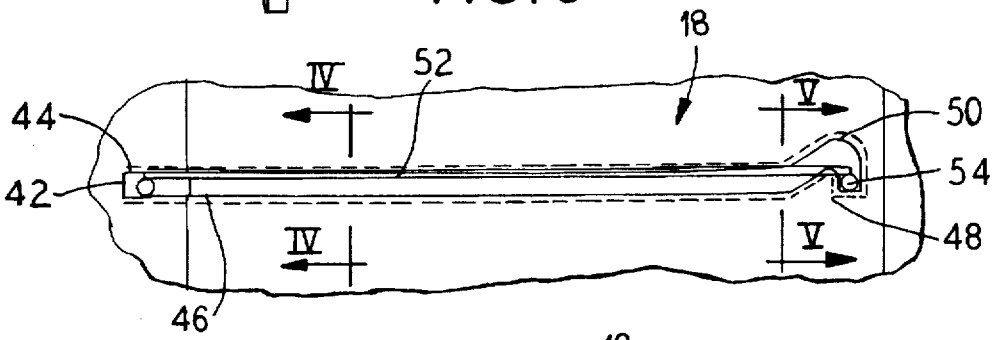
FIG. 3 is a fragmentary elevational view of a shelf supported on the integral shelf support of the liner of the present invention.
Figure 4:
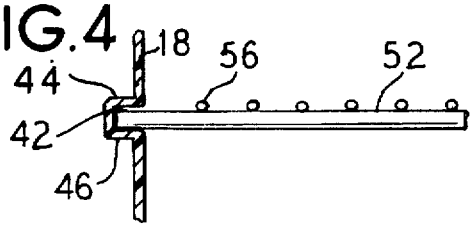
FIG. 4 is a sectional view of a portion of the shelf support of FIG. 3 taken generally along line IV—IV.
Figure 5:
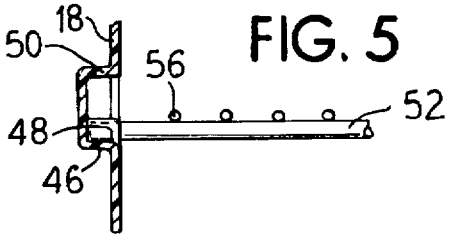
FIG. 5 is a sectional view of another portion of the shelf support of FIG. 3 taken generally along line V—V.

The shelf slot 42 of the freezer compartment 12 is shown in FIGS. 3–5. As illustrated, the shelf slot 42 includes an upper interior surface 44 and a lower interior surface 46 as well as at least one stop 48 formed in the lower surface 46 and a recess 50 formed in the upper surface 44. A shelf 52 is supported within the shelf slot 42. The shelf 52 rests on the lower interior surface 46 and is inserted such that the rear end 54 of the shelf 52 (positioned at the rear of the compartment) is forced over the stop 48 formed in the lower interior surface into the recess 50 formed in the upper interior surface 44 and then returns to rest on the lower interior surface 46. As a result, the shelf 52 is retained in a fixed position between a pair of the shelf slots 42.

FIG. 4 illustrates a sectional view taken generally along line IV—IV of FIG. 3, and FIG. 5 illustrates a sectional view generally taken along line V—V of FIG. 3. As seen in FIGS. 4 and 5, the shelf 52 includes a plurality of transverse bars 56 which support one or more products placed onto the shelf 52. Of course, a solid shelf, such as one made of glass, could be used in lieu of an open wire rack support.

FIGS. 6–11, 13 and 14 illustrate various shelving systems for the fresh food compartment 14. The shelving system illustrated in FIGS. 6–8 includes two stops within the shelf slot whereas the shelving system illustrated in FIGS. 9–11, 13 and 14 includes a single stop within the shelf slot.

Figure 6:
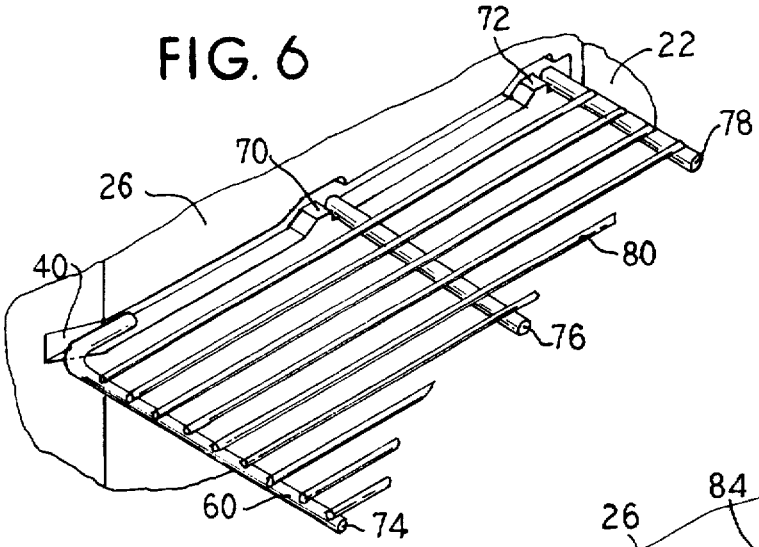
FIG. 6 is a perspective view of a fixed shelf in the shelf support in the liner in one embodiment of the present invention.

In FIG. 6, a fixed shelf 60 is shown within a shelf slot 40 having two stops 70 and 72. The fixed shelf 60 has three cross bars 74, 76 and 78 substantially perpendicular to a plurality of transverse bars 80. The rearwardmost cross bar 78 guides the shelf 60 within the shelf slots 40 over the first stop 70 and the second stop 72 until the cross bar 78 reaches the end of the shelf slot 40 near the rear wall 22. The cross bar 76 is located intermediate the forwardmost cross bar 74 and the rearwardmost cross bar 78. The cross bar 76 supports the transverse bars 80 and is engaged within the shelf slot 40 beyond the stop 70. The shelf 60 is, therefore, fixed intermediate the sidewalls 26 and 28 of the liner 16 such that the shelf 60 cannot be moved when secured within the refrigerator compartment 14 without forcing the cross bar 76 over the stop 70 to release the shelf 60, or without forcing the cross bar 78 over the stop 72.

Figure 7:
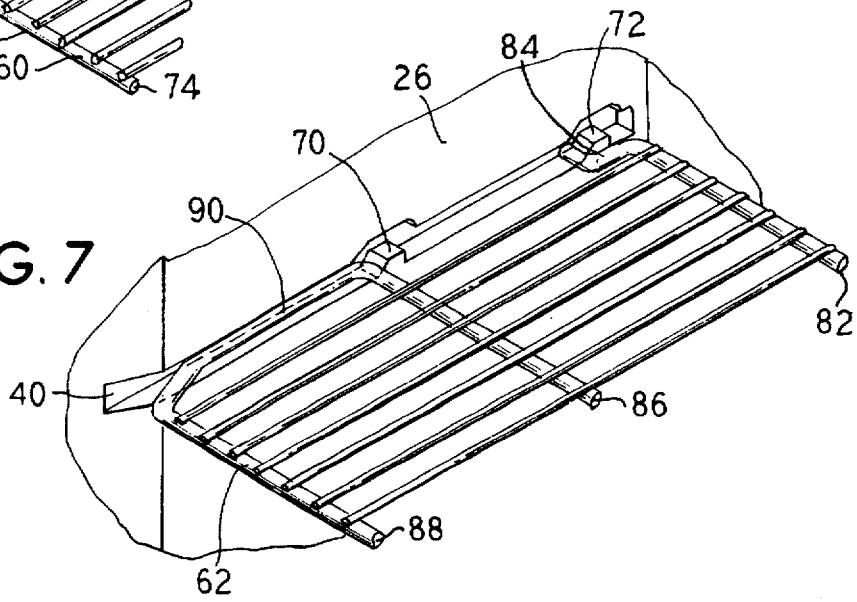
FIG. 7 is a perspective view of a pull-out shelf of the shelf support in the liner in an embodiment of the present invention.

FIG. 7 illustrates a pull-out shelf 62 which, like the fixed shelf 60 in FIG. 6, is supported by the bottom surface of the shelf slot 40. The fixed shelf 62 includes a rearwardmost cross bar 82 with an integrally formed L-shaped leg 84 which slidingly engages the interior of the shelf slot 40 such that the L-shaped leg 84, when the pull-out shelf 62 is fully inserted, is stopped at the forward portion of the stop 72.

Two other cross bars 86 and 88 are integrally related to form a U-shaped member by a connecting bar 90. The intermediate cross bar 86 at the point where it meets the connecting bar 90 may contact the first stop 70 within the shelf slot 40 when the shelf 62 is fully inserted within the compartment 14. However, other configurations of the cross bars 86, 88 and the connecting bar 90 may be used since the cross bar 82 limits the extent the shelf 62 may be pulled out by a user as desired.

When the pull-out shelf 62 is pulled out by a user, the end of the L-shaped leg 84 and the connecting bar 90 supported on the bottom surface of the shelf slot 40 slidingly moves along the bottom surface of the shelf slot until the L-shaped leg 84 contacts the backwall of the stop 70. The stop 70, therefore, prevents the pull-out shelf 62 from further forward movement preventing simple pull-out removal of the shelf 62.

Figure 8:
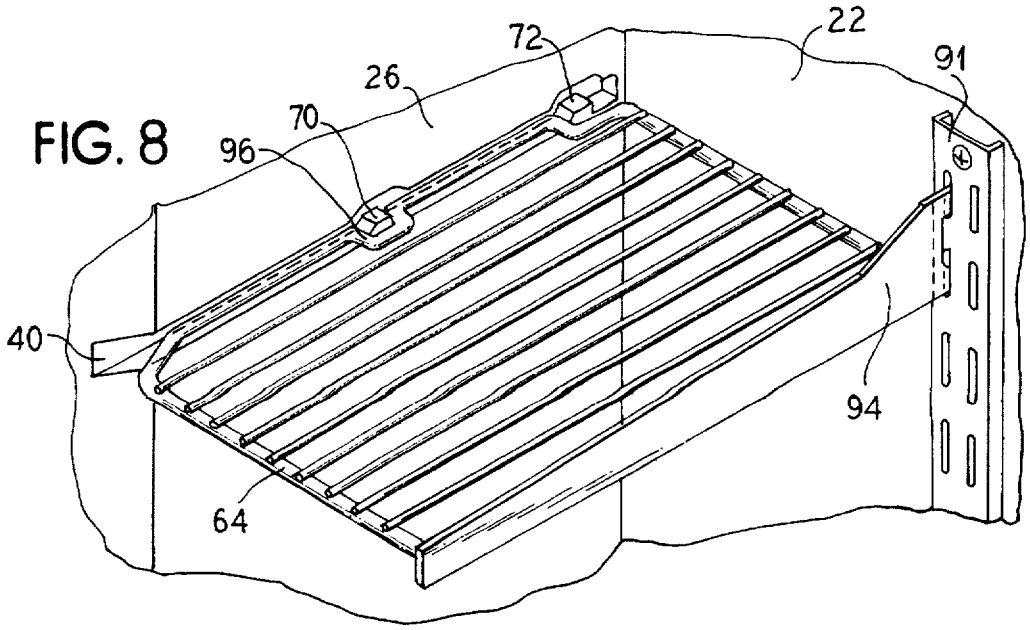
FIG. 8 is a perspective view of a half-width shelf with a cantilever support in an embodiment of the liner of the present invention.

As illustrated in FIG. 8, a half-width shelf 64 is shown with a ladder 92 mounted centrally on the rear wall 22 of the compartment 14. The ladder 91 is retained by at least one screw 93 that mounts into a corresponding screw anchor (not shown) which is positioned on the outside of the rear wall 22 of the liner 16. The ladder 92 secures a cantilever 94 which supports one side of the shelf 64 as is well known in the art. The other side of the shelf 64 is supported by the shelf slot 40 of the present invention having two stops 70 and 72. The stop 70 interacts with the sidewall of the shelf 64 to prevent the shelf 64 from pivoting out from the ladder 91. The sidewall of the shelf 64 supported within the slot 40 includes an indented portion 96 which is supported around the first stop 70. Of course, other means for supporting the shelf 64 other than using the cantilever 94 may be implemented.

FIGS. 9–11 illustrate the pull-out shelf 62' (FIG. 9), the fixed shelf 60' (FIG. 10) and the half-width shelf 64' (FIG. 11) corresponding to the shelves illustrated for the two-stop slots in FIGS. 6–8. The shelf slot 40' is substantially identical to the shelf slot 40 illustrated in FIGS. 6–8 except that a single stop 70' is only required rather than the two stops 70 and 72 within the slot 40 previously described.

The pull-out shelf 62' of FIG. 9 is supported within the slot 40' in the sidewall 26 of the compartment 14. The slot 40' has a projecting stop 70' such that when the shelf is pulled out by a user by pulling a forwardmost cross bar 88', a rearwardmost cross bar 82' prevents additional forward movement of the shelf 62' when the cross bar 82' contacts the back wall of the stop 70'. The shelf 62' may be removed by clearing the cross bar 82' over the stop 70'.

FIG. 10 illustrates the fixed shelf 60' within the slot 40' containing a single stop 70'. The fixed shelf 60' is secured about the single stop 70' by a fourth cross bar 98 in addition to the cross bars 74', 76' and 78'. The cross bar 76' is supported on the bottom wall 41 of the slot 40' just before the front wall 71 of the stop 70' as illustrated in the cross-sectional view of FIG. 12. The additional cross bar 98, as a result, is fixed behind the back wall 73 of the stop 70' when the shelf 60' is in its fixed position. A recess portion 100 in the slot 40' allows the shelf 60', and more specifically the cross bar 98, to pass over the stop 70' and secure in a fixed position.

FIG. 11 illustrates a half-width shelf 64' with a ladder 91 mounted on the rear wall 22 of the compartment 14. A cantilever 94 is attached to the ladder 91 for supporting one side of the shelf 64'. The ladder 91 is retained by at least one screw 93 that mounts into a corresponding screw anchor (not shown) which is positioned on the outside of the rear wall 22 of the liner 16.

Like the shelf 64 illustrated in FIG. 8, the shelf 64' of FIG. 11 is fixed into place within the slot 40' by the single stop 70'. The indented portion 96' in the sidewall of the shelf 64' is secured around each side of the stop 70' when the shelf 64' is inserted and is supported by the bottom wall of the slot 40'.

Figure 13:
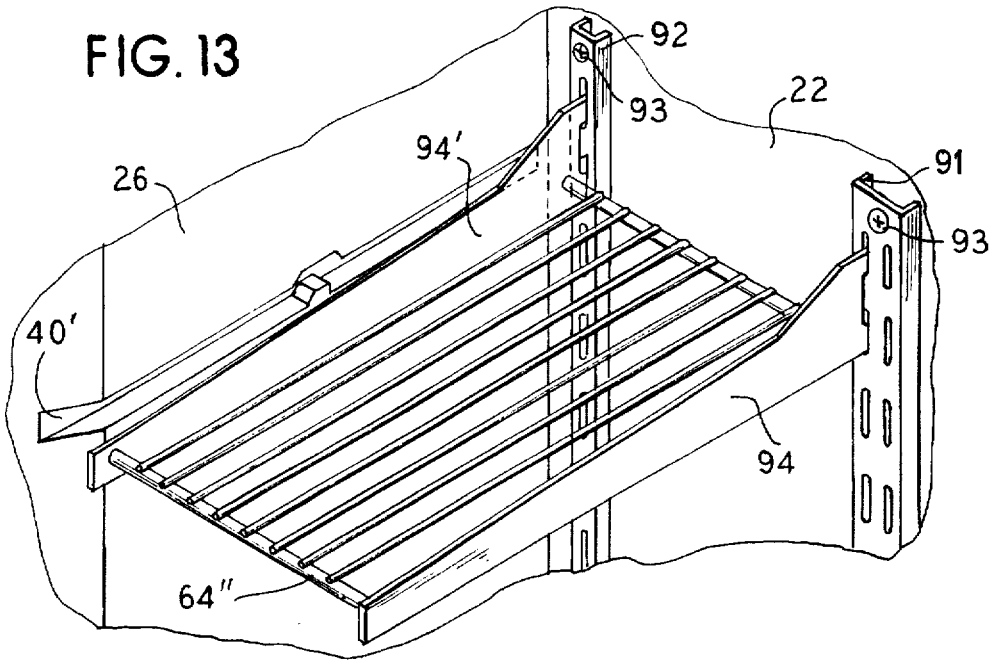
FIG. 13 is a perspective view of a half-width shelf with cantilever support within the liner of the present invention.
Figure 14:
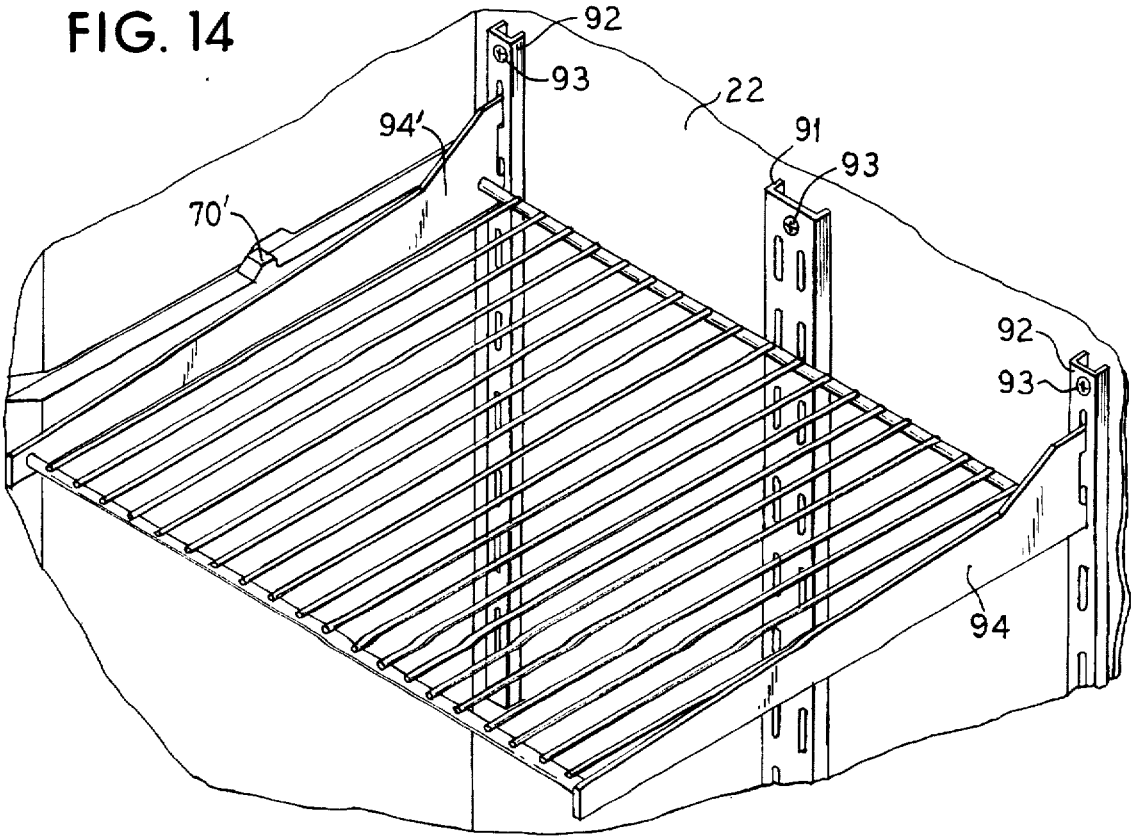
FIG. 14 is a perspective view of a full-width shelf with cantilever support within the liner of the present invention.

FIGS. 13 and 14 illustrate a half-width shelf 64" and a full-width shelf 65, respectively. The half-width shelf 64" as illustrated in FIG. 13 is supported on both sides by cantilevers 94 and 94'. Each cantilever 94 and 94' is connected to ladders 91 and 92, respectively. The slot 40' in the sidewalls 26 is included as a decorative styling feature for this particular application of the two cantilevers 94 and 94' connected to the ladders 91 and 92. If the shelf 65 requires replacement with another type of shelf, such as shown in FIG. 11, the slot 40' may then be used for securing this type of shelf. The ladders 91 and 92 are retained by at least one screw 93 for each of the ladders 91 and 92. Although only one screw is shown per ladder, it will be understood by those skilled in the art that a plurality of screws may be required for fixing either of the ladders 91 and 92 to the rear wall 22.

FIG. 14 illustrates another embodiment of the present invention in which a full-width shelf 65 is supported by cantilevers 94 and 94' connected to ladders 92 which are secured to the rear wall 22 by at least one screw 93 mounted into screw anchors (not shown) positioned on the outer side of the rear wall 22 of the liner 16. Slot 40' with the single stop 70' can be used with this arrangement such that if the shelf is to be replaced with a pull-out shelf or a fixed shelf, for example, a slotted liner can support this type of shelf as well as any other type of shelf. In addition, the ladder 91 may be optionally provided as shown or may be removed from the rear wall 22.

The invention is not limited to the particular details of the apparatus depicted, and other modifications and applications are contemplated. Certain other changes may be made in the above described apparatus without departing from the true spirit and scope of the invention herein involved. It is intended, therefore, that the subject matter in the above depiction should be interpreted as illustrative and not in a limiting sense.

The embodiments of the invention in which an exclusive property or privilege is claimed are defined as follows:

1. A liner for a cabinet of a refrigeration device comprising:

a pair of substantially planar parallel sidewalls, a rear wall, a top wall and a bottom wall integrally forming an interior of the refrigeration device;

said sidewalls each having at least one slot integrally formed therein supporting at least one shelf therein such that said shelf is supported in a horizontal plane by a bottom surface of at least one of said slots, each of said at least one slots extending into a plane of the sidewalls away from the interior of the refrigeration device; and a limit means in each of said slots preventing said shelf supported on said bottom surface from moving in at least one direction.

2. The liner of claim 1 wherein said limit means is intermediately situated in each of said slots.

3. The liner of claim 1 wherein said at least one slot extends from a point near an opening of said cabinet to a point near said rear wall.

4. The liner of claim 1 wherein one side of said shelf may be supported by a cantilever.

5. The liner of claim 4 wherein said rear wall includes a support means for supporting an end of said cantilever.

6. The liner of claim 1 wherein said shelf is supported in a horizontally fixed position.

7. The liner of claim 1 wherein said limit means allows forward movement of said shelf for a predetermined distance.

8. The liner of claim 1 wherein said limit means is near one end of each of said at least one slots wherein said end is near said rear wall.

9. A liner for a cabinet comprising:

a pair of substantially planar parallel sidewalls, a rear wall, a top wall and a bottom wall integrally forming an interior of the cabinet; and said sidewalls each having a plurality of slots integrally formed therein capable of mounting a shelf such that said shelf is supported in a horizontal plane by a bottom surface of at least one of said plurality of slots, each of said plurality of slots extending into a plane of the sidewalls away from the interior of the cabinet and further having at least one limit means in each of the plurality of slots preventing movement of the shelf in at least one direction.

10. The liner of claim 9 wherein each of said plurality of slots extend from a point near an opening of said cabinet to a point near said rear wall.

11. The liner of claim 9 wherein one side of said shelf is supported by a cantilever, said cantilever supported by a support means on said rear wall.

12. The liner of claim 9 wherein said shelf is supported in a horizontally fixed position.

* * * * *